United States Patent [19]

Meisterlin

[11] Patent Number: 4,629,538

[45] Date of Patent: Dec. 16, 1986

[54] METHOD FOR ELECTROPLATING DEEP POCKETED ARTICLES

[75] Inventor: Carl A. Meisterlin, Long Beach, Calif.

[73] Assignee: La Shea Corporation, Carlsbad, Calif.

[21] Appl. No.: 795,895

[22] Filed: Nov. 7, 1985

[51] Int. Cl.[4] ..... C25D 7/04

[52] U.S. Cl. ..... 204/26

[58] Field of Search ..... 204/24, 26

[56] References Cited

U.S. PATENT DOCUMENTS 2,331,071 10/1943 Halvorsen ..... 204/25

2,484,068 10/1949 Booe ..... 204/26

3,483,097 12/1969 Bush ..... 204/26

*Primary Examiner*—T. M. Tufariello

*Attorney, Agent, or Firm*—Morland C. Fischer

[57] ABSTRACT

A method for electroplating a deep pocketed article, such as, for example, a plastic cosmetic holder having an arrangement of storage holes formed therein. A partially open grid pattern is formed at the bottom of the pockets or holes to permit trapped plating material from a metal bath to be quickly and reliably drained. The grid pattern facilitates the rack plating of a plurality of articles by venting excess plating material from the pockets back to the metal bath before the article is transferred to a succeeding bath.

10 Claims, 5 Drawing Figures

METHOD FOR ELECTROPLATING DEEP POCKETED ARTICLES

BACKGROUND OF THE INVENTION

1. Field of the Invention

This invention relates to a reliable and efficient method for electroplating large articles with relatively deep pockets or holes, such as, for example, cosmetic articles having pockets or holes for storing cosmetic related items.

2. Prior Art

During the manufacture of certain articles, it is often desirable to coat the exterior surface of the article to provide an aesthetically pleasing appearance. This is particularly true in the cosmetic industry where articles are commonly finished (e.g. electroplated) with a metallic material. However, the process by which an article is electroplated has been cumbersome, time consuming, and expensive, particularly when the article to be finished has a plurality of relatively deep pockets or holes. That is, the article is typically placed into one of a series of baths of metal plating material, and the pockets are filled with such material. Before the article can be transferred to another bath, the trapped plating material must first be removed from the pockets so as not to contaminate a succeeding bath. Before the present invention, there has been no efficient way to remove such trapped plating material from the pockets. Consequently, each article must be drained of excess fluid, rinsed, and dried, one article at a time. Therefore, excess plating material is often wastefully discarded or expensive and complex handling equipment must be utilized to increase productivity.

As a result of the foregoing, plating costs increase significantly with the number of baths into which an article must be placed to complete the plating process. By way of example, a conventional chrome plating technique typically requires approximately 40 different vats or baths, and a conventional brass plating technique typically requires 50 to 60 different vats or baths. Accordingly, because of the slow one-at-a-time electroplating method which is characteristic of the prior art, the ability to conveniently rack plate a multiplicity of large, deep pocketed articles has heretofore been hampered.

Examples of conventional plating techniques can be found by referring to one or more of the following U.S. Pat. Nos.:

2,331,071 Oct. 5, 1943
2,484,068 Oct. 11, 1948
3,483,097 Dec. 9, 1969

SUMMARY OF THE INVENTION

Briefly, and in general terms, this invention relates to a method for rapidly and reliably electroplating the exterior of a relatively large, deep pocketed article, such as a plastic cosmetic holder, or the like, having a plurality of storage pockets or holes formed therein for receiving cosmetic items. The method includes the step of establishing a partially open grid pattern at the bottom of each of the holes. The open areas of each grid pattern are selected to be large enough to permit the unimpeded drainage of plating material but small enough so as to prevent the cosmetic item from falling out the bottom of the storage holes in which the item is located. Thus, when the cosmetic article is first submerged in and then removed from the bath of metallic plating material, excess material which is trapped within the storage holes will be quickly and easily drained back to the bath. Hence, the cosmetic article can be transferred to succeeding plating baths without wasting time and money to dispose of trapped plating material. Moreover, there is no need for special electrodes to be located in close proximity to the article in order to electroplate within the holes. What is more, and by virtue of the present method step, a plurality of cosmetic articles can be concurrently electroplated by a time and money saving rack plating technique.

DESCRIPTION OF THE PREFERRED EMBODIMENT

Figure 1:
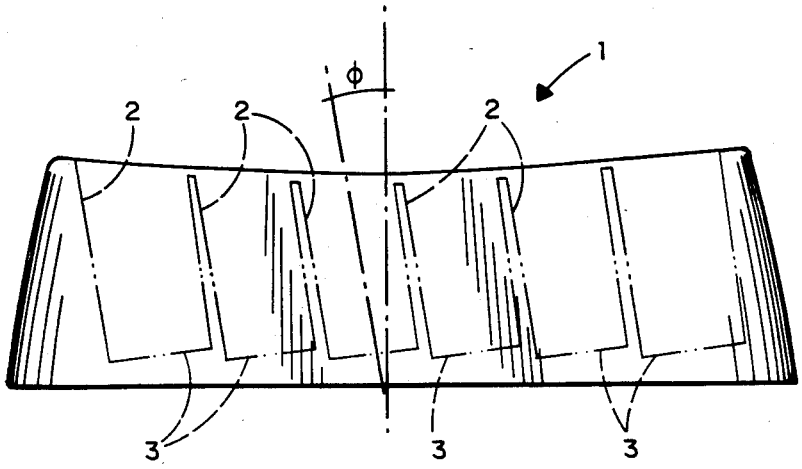
FIG. 1 is a side elevation showing a cosmetic article to be electroplated according to the present method.
Figure 2:
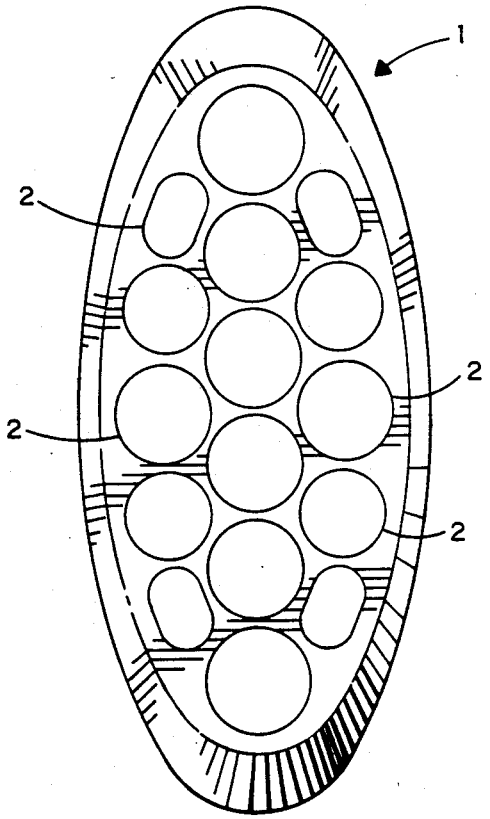
FIG. 2 is a top view of the cosmetic article of FIG. 1.
Figure 3:
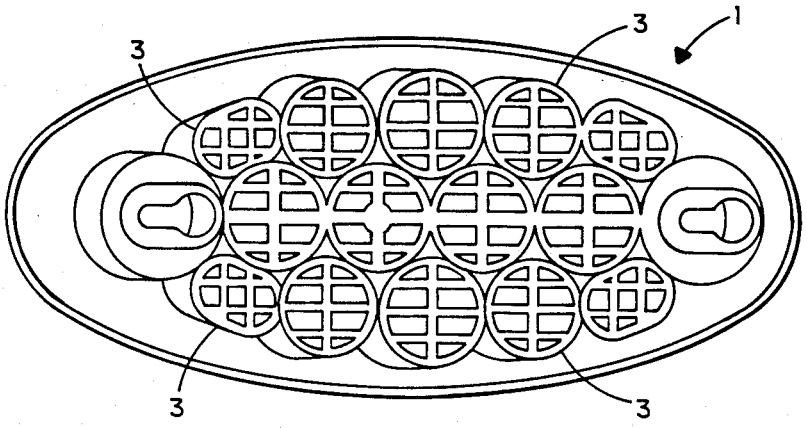
FIG. 3 is a bottom view of the cosmetic article of FIG. 1.

Referring concurrently to FIGS. 1–4 of the drawings, a cosmetic holder 1 is shown having an arrangement of relatively deep (e.g. approximately 2.5 inches) storage holes or pockets 2 extending downwardly therein. An assortment of cosmetic items, such as bottles, scissors, eyebrow pencils, and the like, may be located within the storage holes. Although a cosmetic holder is described below, it is to be understood that such a cosmetic holder is chosen for purposes of example only. It is to be understood that the present method is also applicable to the surface treatment (e.g. electroplating) of any deep pocketed article including, but not limited to, those for holding pencils and/or pens, tools, cooking utensils, and the like.

Cosmetic holder 1 is typically manufactured from plastic. The present method permits a plastic article to be rapidly and reliably electroplated with an available metal material including brass, brushed antiqued brass, chrome, and the like, so as to provide an aesthetically pleasing finish over the exterior surface of such article. More particularly, and in accordance with the present method, the bottom 3 of each storage hole 2 of cosmetic holder 1 is provided with a partially open grid pattern, so as to permit fluid communication between the interior and the exterior of the holes.

Figure 4:
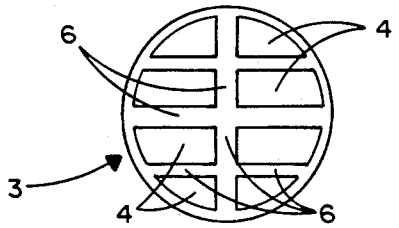
FIG. 4 is a detailed view of the grid pattern formed at the bottom of the cosmetic article as shown in FIG. 3.

As is best shown in FIG. 4, the bottom grid patterns 3 consist of alternating open and closed areas 4 and 6. The areas of the bottom grid pattern 3 are dimensioned such that each of the open areas 4 is large enough to permit the unimpeded drainage of plating material and the elimination of trapped gas bubbles (as will soon be explained) but small enough to prevent a cosmetic item from falling through the bottom of a storage hole 2 in which the item is located. According to a preferred embodiment, the closed areas 6 comprise a matrix of solid ribs which are aligned perpendicular to one another across the bottom 3 of each storage hole 2 so as to define the open areas 4 therebetween.

As is best shown in FIG. 1, the holes 2 may be formed within the cosmetic holder 1 at an angle, designated $\phi$, with a vertical reference line. By way of example, the angle $\phi$ is 8 degrees. The angled holes help to prevent the accumulation of excess plating material (as will also soon be explained) and facilitate the drainage of such material through the open areas of the vent pattern.

Figure 5:
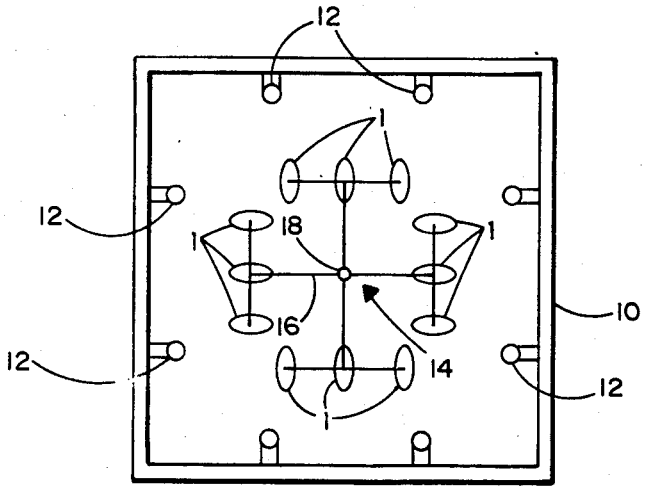
FIG. 5 is a top view of a plating tank to diagrammatically illustrate the rack plating of a plurality of the cosmetic articles of FIG. 1.

Referring concurrently to FIGS. 1–5 of the drawings, the details for electroplating the cosmetic holder 1 with a high quality, long-lasting metallic coating is now disclosed. As is best shown in FIG. 5, a vat or tank 10 containing a metal plating material has a plurality of conventional electrodes 12 uniformly disposed therearound and immersed within the metal material. Typically, the tank 10 is one of a number of tanks into which the cosmetic holder 1 must be submerged to complete the electroplating process.

As will now be described, and by virtue of the grid pattern of FIG. 4 at the bottoms 3 of storage holes 2, a multiplicity of cosmetic holders may be efficiently plated by means of a suitable rack plating apparatus 14, so as to minimize the expenditures of time, money and material. That is, arrays of cosmetic holders 1 are securely arranged on each of the sides of a rack 16. The rack may be supported by a chain 18 and moved in and out of a tank and from tank to successive tank by way of an overhead crane (not shown). In FIG. 5, the rack 16 is lowered into the tank 10 so that all of the cosmetic holders thereon are submerged within the metal plating material. After a suitable time has elapsed, the rack is withdrawn from the tank. Excess plating material which is trapped within the holes 2 will be efficiently drained through the open areas 4 at the bottom of holes 2 back to the tank 10 without either manual intervention or the requirement for additional handling. Thus, such excess material is not disposed of and wasted as in conventional electroplating techniques.

Further advantages of the present method include permitting the thickness and uniformity of the plating material and the depth at which the plating material is deposited within the holes to be maximized relative to conventional electroplating techniques. Thus, not only can a plastic article be electroplated, but increased surface areas of relatively deep holes or pockets formed therein can likewise be plated. Moreover, the conventional electroplating technique requires that an electrode be placed in or near a hole to be treated. However, because of the unimpeded flow an improved circulation of plating material through the bottoms 3 of the storage holes 2, the electrodes 12 need not be in close proximity to the cosmetic holder 1, but may otherwise be arranged around the perimeter of the tank 10.

It will be apparent that while a preferred embodiment of the invention has been shown and described, various modifications and changes may be made without departing from the true spirit and scope of the invention.

Having thus set forth a preferred embodiment of the present invention, what is claimed is:

1. A method for plating an article having a number of storage pockets formed therein, said method including the step of forming a partially open grid pattern in the bottom of each of said pockets for permitting the fluid communication of a plating material between the interior and exterior of said pockets by way of said grid pattern.

2. The method recited in claim 1, including the additional step of forming said grid pattern from alternating open and closed areas, said open areas being large enough to permit fluid communication therethrough and small enough to prevent any items stored in said pockets from falling out of said article through the bottoms of said pockets.

3. The method recited in claim 2, including the additional step of forming said closed areas from solid ribs which intersect one another in perpendicular alignment for defining said open areas therebetween.

4. The method recited in claim 1, including the additional step of forming said article from plastic.

5. The method recited in claim 1, including the additional step of forming said storage pockets so that the longitudinal axes thereof form an angle with respect to the vertical.

6. The method recited in claim 1, including the additional steps of securing said article to a mobile rack, submerging said article in a tank of plating material, withdrawing said article from the tank, and permitting excess plating material in the pockets of said articles to drain back to the tank by way of said grid pattern.

7. The method recited in claim 6, including the additional step of locating one or more electrodes around the perimeter of the tank and in engagement with the plating material.

8. The method recited in claim 1, including the additional step of electroplating said article with a metallic plating material.

9. A method for electroplating a plastic article having a number of relatively deep pockets formed therein, said method comprising the steps of:

forming a grid pattern having alternating open and closed areas in the bottom of each of said pockets for permitting communication between the interior and exterior of said pockets by way of said grid pattern, submerging said article in a tank of metallic plating material, withdrawing said article from the tank, and permitting excess plating material in the pockets of said article to drain back to the tank by way of said grid pattern.

10. The method recited in claim 9, including the additional step of securing said article to a mobile rack for submerging and withdrawing said article from the tank.

* * * * *